US005141150A

United States Patent [19]

Plaessmann

[11] Patent Number: 5,141,150

[45] Date of Patent: Aug. 25, 1992

[54] POURING SPOUT

[75] Inventor: Frederick A. Plaessmann, Edison, N.J.

[73] Assignee: Seal Spout Corporation, Liberty, N.J.

[21] Appl. No.: 470,074

[22] Filed: Jan. 25, 1990

[51] Int. Cl.[5] ..... B65D 43/16

[52] U.S. Cl. ..... 229/123.3; 229/102; 229/123.1; 229/125.04; 493/87; 493/961

[58] Field of Search ..... 40/312; 206/807, 621.3, 206/621.4, 621.5, 621.6, 631.1, 631.2; 229/102, 123.1, 123.3, 123.2, 125.15, 125.04; 215/254, 253; 220/268, 266

[56] References Cited

U.S. PATENT DOCUMENTS

| | | | |
|---|---|---|---|
| 2,005,831 | 6/1935 | Shaw | 229/125.04 |
| 2,287,893 | 6/1942 | Lundberg | 229/123.3 |
| 2,323,447 | 7/1943 | Chase | 206/631.2 |
| 2,540,321 | 2/1951 | Cartwright | 229/125.04 |
| 2,684,792 | 7/1954 | Kraus | 229/123.2 |
| 2,812,126 | 11/1957 | Graybill | 206/631.2 |
| 2,812,127 | 11/1957 | Graybill | 206/631.2 |
| 2,983,410 | 5/1961 | Klausmann | 229/125.15 |
| 3,085,733 | 4/1963 | Umanoff | 206/631.2 |
| 3,549,079 | 12/1970 | Northrup | 206/631.2 |
| 3,854,581 | 12/1974 | Jones, Jr. | 206/807 |
| 3,977,591 | 8/1976 | Martensson et al. | 229/123.1 |
| 4,809,853 | 3/1989 | Weber | 206/631.2 |
| 4,919,313 | 4/1990 | O'Brien | 229/102 |

FOREIGN PATENT DOCUMENTS

| | | | |
|---|---|---|---|
| 1145949 | 3/1963 | Fed. Rep. of Germany | 229/125.04 |
| 3903179 | 8/1990 | Fed. Rep. of Germany | 229/102 |
| 1016416 | 12/1966 | United Kingdom | 206/631.2 |

*Primary Examiner*—Stephen Marcus
*Assistant Examiner*—Christopher J. McDonald
*Attorney, Agent, or Firm*—Weingram & Zall

[57] ABSTRACT

A tamper evident container is provided having a pouring spout which includes a shoot surface pivotally attached to a wall of the container. The shoot extends beyond and overlays an opening in the container wall to securely maintain the opening in the wall closed. The shoot includes a tip used to open the spout. A tamper evident sealing label overlays the spout and tip. The label includes a frangible sheet having an adhesive portion for attaching the label to the container surface and an adhesive free portion along a portion of an edge of a label. A tear line is provided across the label dividing the label into a first portion which includes the adhesive free portion and a second portion. The first portion overlays the tip of the spout and the second portion overlays the remaining portion of the spout. When the label is attached to the container surface the adhesive free portion may be grasped and torn away from the container to remove the first portion of the label along the tear line revealing the tip for opening the spout and leaving the second portion of the label attached to the container covering the remaining portion of the spout. When the tip is pulled away from the wall of the container to pivotally open the spout, the second portion of the label is torn.

6 Claims, 2 Drawing Sheets

FIG-1
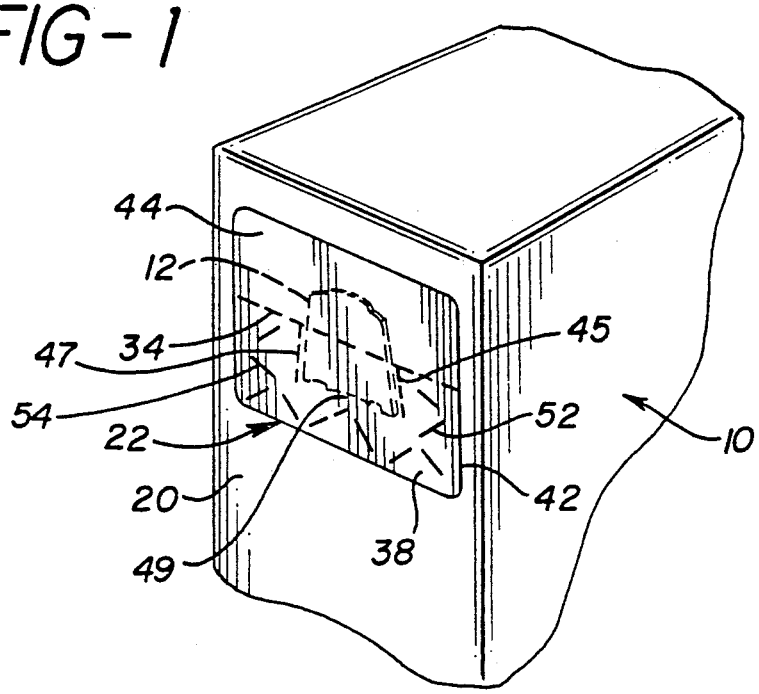
FIG-2
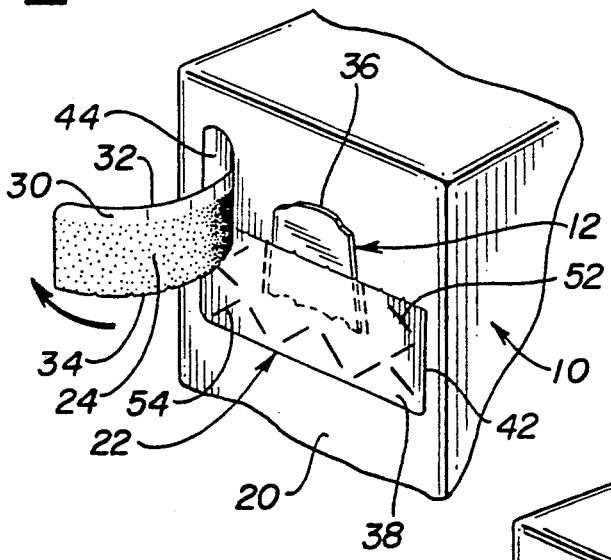
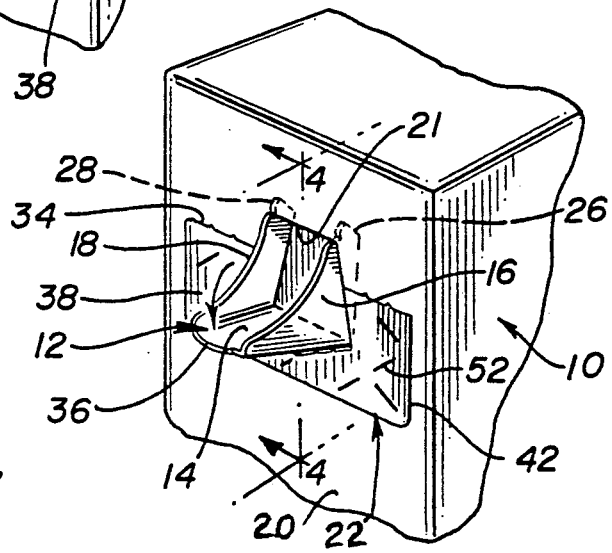
FIG-3

POURING SPOUT

BACKGROUND OF THE INVENTION

1. Field of the Invention

This invention relates to pouring spouts for containers and in particular, a pouring spout which has a tamper evident seal thereon.

2. Prior Art

For dry granular items such as bread crumbs, salt, or other fine powders that are dispensed from boxes or containers, a preferred method of dispensing such granular material is by means of a retractable pouring spout that has been fastened to the box.

Machines for inserting spouts into the tops and sides of containers are well known. A spout is usually placed in a container before it is filled. However, whether the spout is placed in the container before or after it is filled, insertion of such spouts requires synchronization between filling of the containers, delivery of the container to the insertion station, insertion of spouts therein, speed of the assembly line, etc. Examples of spout inserting machines are described in U.S. Pat. Nos. 4,072,117; 3,690,223; 3,523,512; 3,385,248; 3,381,645; and 4,583,899. The disclosures of all of these patents are incorporated herein by reference.

The need to install tamper indicating or tamper evident means on packages has been highlighted by the relatively recent intentional contamination of TYLENOL and other non-prescription drugs and consumable products. A problem associated with the use of pouring spouts is that they are easily tampered with. There is no means by which it can be determined if the spout itself has been opened other than by providing an overlay on the spout. It is important, however, that any such overlay be positioned exactly on the spout because if it is not then a contaminant may still be poured into the container through the spout. The label must also not be removable. Thus anyone attempting to tamper with the spout will be required to break the sealing label to open the spout. A broken sealing label will thus indicate that there has been tampering with the spout.

Additionally, the exact positioning of a label in relation to the spout, e.g. the label completely covers the spout, can also be important in maintaining a seal to insure the usefulness of the product therein. For example, in containers which have water sensitive material such as soaps or detergents a label which overlays the spout so as to hermetically seal the spout opening is advantageous in extending the shelf life of the material in the container. The prevention of moisture from entering the container will enable the material to stay in the box without caking or otherwise deteriorating the material.

Further, as is often the case in the retail trade, containers having pouring spouts are often stacked one on top of the other. Such stacking tends to crush or distort the containers. By placing a label over the spout it prevents the spout from being forced open by such crushing thereby preventing spilling of the materials from the containers while also making the material in the individual containers less vulnerable to contamination.

An attempt to solve some of the problems associated with applying sealing labels to spouts has been resolved by the Assignee in copending U.S. application Ser. No. 07/416,857 filed Oct. 4, 1989, now U.S. Pat. No. 5,022,954 entitled "APPARATUS FOR APPLYING LABELS TO CONTAINERS" which describes and claims automatic and continuous application of labels to containers. Generally, a continuous tape or web, having separate labels thereon, is fed to an indexing work table through a label applying apparatus. The label applying apparatus is coordinated with the position of the table, containers on the table, and spouts in the containers. The indexing work table moves the containers in a coordinated sequence to a work station wherein the labels are applied at the desired position on the containers over the pouring spouts.

A problem which arises when a label is properly placed over a spout to, for example, hermetically seal the spout, is that the spout cannot be opened without tearing off the label to reveal the spout, which can cause the box to tear and may even destroy the integrity of the spout mechanism. This invention solves this problem.

Relevant art relating to overlays or labels applied over pouring spouts include the following U.S. Patents:

U.S. Pat. No. 1,155,681 to Pinkerton:
U.S. Pat. No. 1,366,006 to Jehn:
U.S. Pat. No. 1,606,194 to Strafford;
U.S. Pat. No. 1,914,543 to Trost;
U.S. Pat. No. 1,961,055 to Lewin;
U.S. Pat. No. 2,123,546 to Perkins;
U.S. Pat. No. 2,239,691 to Becker:
U.S. Pat. No. 2,330,310 to Parsons;
U.S. Pat. No. 2,444,104 to Marken;
U.S. Pat. No. 2,651,862 to Fine;
U.S. Pat. No. 2,713,956 to Everett:
U.S. Pat. No. 3,071,882 to Eisman, et al.; and
U.S. Pat. No. 3,380,181 to Karel.

Pinkerton, U.S. Pat. No. 1,155,681 discloses a pouring spout attached to a rectangular package. The spout is covered by a paper seal.

Jehn, U.S. Pat. No. 1,366,006 utilizes cuts in a package which has a pouring opening and two parallel slits cut one at each side of the opening. The spout employs a tongue which is cemented or otherwise secured to the inner surface of the package. The tongue constitutes the hinge for the spout. Wings of the spout pass through the slits. A seal of paper is shown at 15 and is pasted over the spout to prevent loss of the contents of the container during shipment which seal must be broken to reach the spout.

Strafford. U.S. Pat. No. 1,606,194 shows a tab portion 12 which is employed to engage a key of the type commonly used to open a "sardine" can. The tab is attached to a tearing strip which is scored. The key engages the tab and the strip is torn away at the scoring. When the tearing strip is removed an opening remains in which there is mounted the pouring spout.

Trost, U.S. Pat. No. 1,914,543 shows a pouring spout formed in a carton. The spout is covered by a projecting tongue which can be grasped, and "opened" at scored portions to expose the spout. The spout is hinged integrally with the carton, the base of the spout being formed as an extension of the carton.

Lewin, U.S. Pat. No. 1,961,055 discloses a spout with an extending tongue portion on which the spout is hinged. The tongue portion is glued or otherwise affixed to the interior of the carton. Scoring is required to be cut to pull the spout out.

Perkins, U.S. Pat. No. 2,123,546 discloses a patch comprised of a fabric piece with a tacky layer. An adhesive connection is effected between the patch via the tacky layer. Removal of the patch is accomplished by grasping an edge thereof and lifting same.

Becker, U.S Pat. No. 2,239,691 shows a paper cover covering the top surface of the spout in a can of milk. The paper is removed and a tab is used to open the spout.

Parsons, U.S. Pat. No. 2,330,310 features a pouring spout constructed integrally of a material having some degree of resiliency. A thin label or wrapping of the package, is adhesively applied after the spout is attached. A perforation is provided so as to enable the paper to be torn at the location of the spout.

Marken, U.S. Pat. No. 2,444,104, describes a flexible dispensing spout for containers. This covering protects a pouring spout blank.

Fine, U.S. Pat. No. 2,651,862, shows a display device for applying advertising material on paper milk cartons.

Everett, U.S. Pat. No. 2,713,956, discloses a pouring spout in a hermetically sealed coffee can. For sealing the pouring spout, a sheet covers the opening as well as the spout. A loop is exposed from beneath the edge of the sheet which acts to remove or break the seal.

Eisman, et al., U.S. Pat. No. 3,071,882 shows a packaging blank which has areas where different advertising materials may be inserted.

Karel, U.S. Pat. No. 3,380,181 is another packaging device for adding advertising material to milk cartons.

Most of these references describe an integral one-piece overlay or label applied over a pouring spout. As mentioned previously, such an overlay makes it difficult to obtain access to the spout and, when the label is pulled off the container to expose the spout, the box and possibly even the spout mechanism, can be destroyed.

OBJECT AND SUMMARY OF THE INVENTION

It is an object of this invention to provide an improved tamper-evident label and spout for food packages which are used to contain granular articles such as coffee, sugar, salt, etc.

It is another object of this invention to provide a tamper-evident label which can be applied over a pouring spout of a container which provides ease of accessibility to the spout so that it can be opened.

It is still another object of this invention to provide a receptacle for granular materials having a pouring spout therein which has thereon a tamper evident seal which provides a dual measure of tamper evidence.

It is yet another object of this invention to provide a hermetically sealed receptacle having a pouring spout attached thereto which has a tamper evident seal thereon.

A further object of this invention to provide a tamper-evident means which coacts with a pouring spout inserted in the container, said tamper-evident means consisting of a label having different levels of adherence to the container so that a first portion of the label can be removed without removing a second portion of the label.

It is still a further object of this invention to provide a tamper-evident means coacting with a pouring spout inserted in the container which consists of a label wherein different adhesives are used on a first portion and a second portion of the label so that the first portion of the label can be removed without removing the second portion.

It is yet another object of this invention to provide a tamper-evident means which coacts with a pouring spout inserted in the container which consists of a label wherein a first portion of the label is formed in a frangible manner so as to prevent purposeful or inadvertent removal of the entire label to ensure that there will be difficulty in removing one portion of the label as distinguished from the other portion of the label, and in addition will show evidence of an attempt to remove the portion of the label that is more difficult to remove.

Yet another object of this invention is to provide a label which coacts with the pouring spout means to act as a hinge for facilitating actuation of the pouring spout means.

The objects of this invention are achieved by a tamper-evident sealing label comprising:

a frangible sheet having on a surface thereof an adhesive portion having adhesive means for attaching the label to a container surface and an adhesive-free portion along a portion of the edge of the label without adhesive means; and a tear line across the label dividing the label into a first portion which includes the adhesive-free portion and a second portion, whereby when the label is attached to a container surface the adhesive-free portion may be grasped and torn away from the container to remove the first portion of the label along the tear line leaving the second portion of the label attached to the container.

In particular, when used in conjunction with a container having a spout therein, this invention provides a split label wherein the first tear-away portion provides access to the spout, and the second portion maintains the integrity and closure of the spout until it is manually torn when opening the spout. The first tear-away portion provides a "tamper-proof" indication on the package while allowing the integrity of the seal of the spout to be maintained while the second portion maintains the integrity of the slits surrounding the spout.

Another aspect of this invention provides a tamper-evident container comprising:

a container having a pouring spout including a means for opening the spout;

a tamper evident sealing label overlaying the spout and means for opening the spout, the label comprising:

a frangible sheet having on a surface thereof an adhesive portion having adhesive means thereon for attaching the label to the container surface and an adhesive-free portion along a portion of an edge of the label without adhesive means; and a tear line across the label dividing the label into a first portion which includes the adhesive-free portion and a second portion, wherein the first portion overlays the means for opening the spout, whereby, when the label is attached to the container surface, the adhesive-free portion may be grasped and torn away from the container to remove the first portion of the label along the tear line revealing the means for opening the spout, leaving the second portion of the label attached to the container covering the remaining portion of the spout.

BRIEF DESCRIPTION OF THE FIGURES

FIG. 1 is a perspective view of one embodiment of the tamper evident label in use on a container having a pouring spout;

FIG. 2 is a perspective view of the embodiment of FIG. 1 wherein a portion of the label is removed to reveal the means for opening the spout;

FIG. 3 is a perspective view of the embodiment of FIGS. 1 and 2 after a portion of the label is removed and the spout opened.

DETAILED DESCRIPTION OF THE INVENTION

Figure 4:
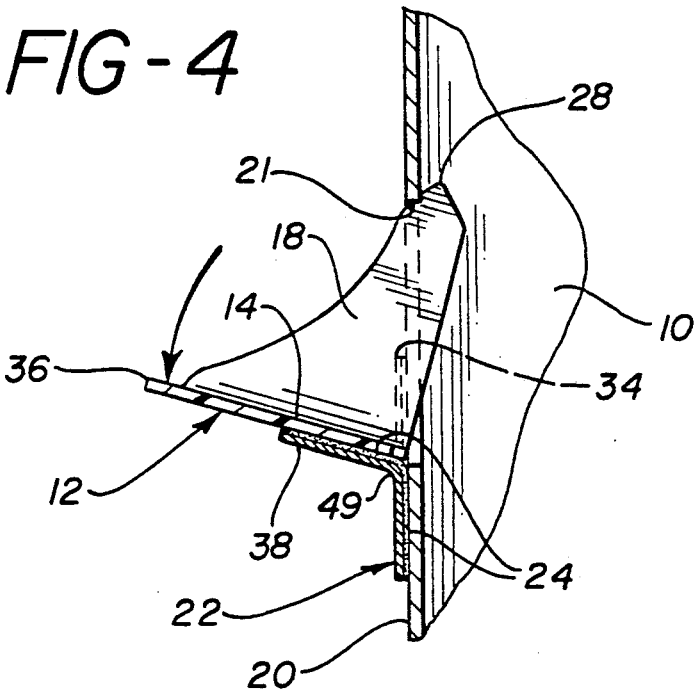
FIG. 4 is a section along line 4—4 of FIG. 3.

In the accompanying drawings like reference numerals indicate like parts.

Referring to FIGS. 1-4, and in particular FIG. 1, container 10 is provided with a spout 12 on container 10. Typically spout 12 is inserted in the side of container 10, although this invention contemplates placing spout 12 in any wall of the container. As shown in FIGS. 3 and 4, spout 12 comprises a chute surface 14 and two side walls 16 and 18. Chute 14 is pivotally attached to the container wall 20. Chute 14, when the spout 12 is closed, extends beyond and overlays the opening 21 in container wall 20 to securely maintain the opening in wall 20 closed. Chute 14 has a tip 36 which is used to open the spout (FIG. 3, arrow). Tip 36 is spaced from side wall 20 so that a fingernail or sharp instrument may be placed between the chute 14 and the side wall 20 to slide the spout open in a manner indicated by the arrow in FIG. 4. When spout 12 is opened, as shown in FIGS. 3 and 4, fingers 26 and 28 engage wall 20 to prevent spout 12 from disengaging from wall 20.

Referring to FIGS. 1 and 2 the tamper evident sealing label 22 is overlaid on the spout and chute tip 36. The label 22 comprises a frangible sheet having on a surface 42 thereof an adhesive portion 24 having an adhesive thereon for attaching the label 22 to the container surface and to the under side of chute 14 of spout 12. This surface also includes, as shown in FIG. 2, an adhesive-free portion 30 along edge 32. This adhesive free portion 30 may run along the full length of edge 32, as shown in FIG. 2, or may only be a portion of an edge (which may include a corner).

A tear line 34 is provided across the label 22. This tear line or perforated line divides the label 22 into a first portion or upper portion 44, which includes the adhesive-free portion 30, and a second or lower portion 38.

The tamper evident sealing label 22 overlays the spout 12 and the means for opening the spout 36. The label 22 is positioned over the spout 12 so that the first portion 44, which includes the adhesive-free portion, overlays the means for opening the spout, e.g. the chute tip 36, and the second portion 38 overlays the remaining portion of spout 12.

Thus, when label 22 is attached to the surface of wall 20 and the adhesive free portion 30 is grasped and torn away from the container as depicted in FIG. 2 (arrow), the top portion of the label 44 is removed along the tear line 34 exposing the means for opening the spout 36. When a consumer notices the top portion of the label 44 is removed, it indicates that there has been tampering with the spout 12.

Even if top label 44 is removed, the lower portion of the label 38, if it is not torn, still maintains the integrity of the spout 12. When tip 36 is used to open the spout as indicated in FIGS. 3 or 4, the side walls 16,18 of spout 12 break the lower portion 38 of label 22 along perforations 45 and 47 to indicate tampering therewith. Perforations 45 and 47 are parallel to the side walls 16,18, but do not extend down lower portion 38 to the hinge 49. Perforations 45 and 47 permit the easy opening of spout 12. If, however, these slits or perforations extended to or below hinge 49 there would be little or no evidence of tampering if the spout 12 were opened.

Referring to FIG. 1, slits or perforations 52,54 are provided in the lower portion label 38. These are used to prevent lower label 38 from being removed without leaving evidence of its removal. For example, if upper portion 44 of the label is peeled away, it might be possible to, at the same time, remove lower label 38. When slits 52,54 are provided, any attempt to remove lower portion 38 would cause fragmentation of lower portion 38 providing evidence of tampering.

Additionally, it may be desirable to use different strengths of adhesive on the lower and upper portions to permit easy removal of the upper portion and more difficult removal of the lower portion, e.g., sufficient to damage the box.

Additionally, the lower portion of the label 44 may be used to assist in pivoting and maintaining the spout 12 in the container without the assistance of any other means. Referring to FIG. 4, this is accomplished by having adhesive layer 24 of first portion 44 attached to side wall 20 below spout 12 and to the underside of chute 14.

Thus, as depicted in FIG. 1, after filling and prior to use, spout 12 is sealed over by the tamper evident sealing label 22 of this invention. If the purchaser wants to use the contents of the package, he grasps adhesive-free edge 32 of label 22 and tears it along the perforated or tear line 34 thus exposing the chute tip 36 by which the spout 12 can be opened. The chute tip 36 is then used to open spout 12 tearing the lower portion 38 of label 22. After a sufficient quantity of material has been poured from the container, the spout 12 can be closed against the side wall 20 to prevent dust, dirt, etc. from finding its way into the package.

Further, the tamper evident label 22 can be printed with instructions as to opening and use of the package as well as a warning that the label should not be broken.

While this invention is described in connection with food packages, it will be understood that it may be used in connection with any other kind of package which packages a granular type product. While it is understood that the container is preferably made of a paper product and the spout made of a polymeric product, it may be desirable to use other type materials, e.g. metallic.

It will be understood that various changes may be made in the form, details, arrangement and proportions of the parts without departing from the scope of the invention.

I claim:

1. A tamper-evident container comprising:

a container having a pouring spout comprising a chute surface pivotally attached to a wall of the container, the chute extending beyond and overlaying an opening in the container wall to securely maintain the opening in the wall closed, the chute including a tip used to open the spout;

a tamper-evident sealing label overlaying the spout and tip, the label comprising:

a frangible sheet having on a surface thereof an adhesive portion having adhesive means thereon for attaching the label to the container surface and an adhesive-free portion along a portion of an edge of a label without adhesive means; and a tear line across the label dividing the label into a first portion which includes the adhesive-free portion and a second portion, wherein the first portion overlays the tip of the spout and the second portion overlays the remaining portion of the spout, whereby when the label is attached to the container surface the adhesive free portion may be grasped and torn away from the container to remove the first portion of the label along the tear line revealing the tip for opening the spout and leaving the second portion of the label attached to the container covering the remaining portion of the spout, whereby when the tip is pulled away from the wall of the container to pivotally open the spout, the second portion of the label is torn.

2. The container of claim 1, wherein the label is rectangular.

3. The container of claim 2, wherein the tear line is substantially parallel to the adhesive-free portion.

4. The container of claim 3, wherein the adhesive means is a pressure-sensitive adhesive.

5. The tamper-evident container of claim 1, further comprising perforations provided in the second portion, wherein, any attempt at removal of the second portion of the label from the container results in the fragmentation of the second portion along the perforations and provide evidence of tampering.

6. A method of manufacturing a tamper-evident container comprising:

providing a container having a pouring spout including means for opening the spout;

providing a tamper-evident sealing label comprising:

(i) a frangible sheet having on a surface thereof an adhesive portion having adhesive means for attaching the label to a container surface and an adhesive-free portion along a portion of an edge of the label without adhesive means; and (ii) a tear line across the label dividing the label into a first portion which includes the adhesive-free portion and a second portion;

applying the label over the spout to cover the spout and means for opening the spout wherein the tear line overlays the spout and the first portion overlays the means for opening the spout and the second portion overlays the remaining portion of the spout, whereby the adhesive-free label may be grasped and torn away from the container to remove the first portion of the label along the tear line revealing the opening means, leaving the second portion of the label attached to the container covering the remaining portion of the spout.

* * * * *